US008508741B2

(12) United States Patent
Kumar

(10) Patent No.: US 8,508,741 B2
(45) Date of Patent: Aug. 13, 2013

(54) FLUID SAMPLING AND ANALYSIS DOWNHOLE USING MICROCONDUIT SYSTEM

(75) Inventor: Sunil Kumar, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 193 days.

(21) Appl. No.: 13/083,923

(22) Filed: Apr. 11, 2011

(65) Prior Publication Data

US 2011/0249266 A1 Oct. 13, 2011

Related U.S. Application Data

(60) Provisional application No. 61/323,133, filed on Apr. 12, 2010.

(51) Int. Cl.
*G01N 21/59* (2006.01)
*E21B 49/08* (2006.01)

(52) U.S. Cl.
USPC ..... 356/440; 356/326; 73/152.28; 73/152.12

(58) Field of Classification Search
USPC ..... 356/432–440, 326; 73/152.17, 152.01, 73/152.03, 152.46, 152.28; 166/250.16, 166/250.05, 100, 264
See application file for complete search history.

(56) References Cited

U.S. PATENT DOCUMENTS

| | | | | |
|---|---|---|---|---|
| 6,026,915 | A * | 2/2000 | Smith et al. | 175/50 |
| 6,100,107 | A | 8/2000 | Lei et al. | |
| 6,945,116 | B2 | 9/2005 | Xie et al. | |
| 6,964,301 | B2 * | 11/2005 | Hill et al. | 166/264 |
| 7,565,834 | B2 * | 7/2009 | Adnan et al. | 73/152.12 |
| 7,575,681 | B2 | 8/2009 | Angelescu et al. | |
| 7,665,519 | B2 * | 2/2010 | Oddie | 166/264 |
| 7,669,469 | B2 * | 3/2010 | Shammai et al. | 73/152.23 |
| 7,691,333 | B2 | 4/2010 | McBride et al. | |
| 7,933,018 | B2 | 4/2011 | Vannuffelen et al. | |
| 2003/0098156 | A1 * | 5/2003 | Follini et al. | 166/264 |
| 2004/0094733 | A1 | 5/2004 | Hower et al. | |
| 2004/0098202 | A1 * | 5/2004 | McNeil et al. | 702/12 |
| 2004/0238218 | A1 * | 12/2004 | Runia et al. | 175/57 |
| 2004/0244971 | A1 * | 12/2004 | Shammai et al. | 166/250.1 |
| 2006/0129365 | A1 * | 6/2006 | Hammond | 703/10 |
| 2007/0035736 | A1 | 2/2007 | Vannuffelen et al. | |
| 2007/0068242 | A1 * | 3/2007 | DiFoggio | 73/152.55 |
| 2008/0165356 | A1 * | 7/2008 | DiFoggio et al. | 356/326 |
| 2009/0120168 | A1 | 5/2009 | Harrison et al. | |
| 2009/0185955 | A1 | 7/2009 | Nellissen | |
| 2010/0017135 | A1 | 1/2010 | Mostowfi | |
| 2010/0147065 | A1 * | 6/2010 | Tan et al. | 73/152.24 |

OTHER PUBLICATIONS

Stone, H.A., et al., "Engineering Flows in Small Devices: Microfluidics Toward a Lab-on-a-Chip," Annu. Rev. Fluid Mech., vol. 36, pp. 381-411 (2004).

(Continued)

*Primary Examiner* — Sang Nguyen
(74) *Attorney, Agent, or Firm* — Mossman Kumar & Tyler PC

(57) ABSTRACT

An apparatus and method for estimating a parameter of interest in a downhole fluid using fluid testing module. The fluid testing module may include: a substrate comprising at least one microconduit, and a sensor. The sensor may be disposed within the at least one microconduit or external. The apparatus may include a fluid transporter for moving fluid within the microconduit. The method includes estimating a parameter of interest using the fluid testing module.

20 Claims, 6 Drawing Sheets

(56) References Cited

OTHER PUBLICATIONS

Squires, T.M., et al., "Microfluidics, Fluid Physics at the Nanoliter Scale," Rev. Modern Phys., vol. 77, pp. 977-1026 (Jul. 2005).
Weinert, F.M. et al., "Optically driven fluid flow along arbitrary microscale patterns using thermoviscous expansion," J. Appl. Phys., vol. 104, Issue 10 (2008).
Whitehill, James et al., "Collection of suspended particles in a drop using low frequency vibration," Appl. Phys. Lett., vol. 96, Issue 5 (2010).
"Swiss solar innovator wins Millenniums Technology prize," BBC News, Jun. 9, 2010, http://news.bbc.co.uk/1/hi/technology/10276652.stm.

* cited by examiner

FLUID SAMPLING AND ANALYSIS DOWNHOLE USING MICROCONDUIT SYSTEM

CROSS-REFERENCES TO RELATED APPLICATIONS

This application claims priority from U.S. Provisional Patent Application Ser. No. 61/323,133, filed on 12 Apr. 2010, the disclosure of which is incorporated herein by reference.

FIELD OF THE DISCLOSURE

This disclosure generally relates to exploration for hydrocarbons involving analysis of fluids of a borehole penetrating an earth formation. More specifically, this disclosure relates to analysis of fluids using a fluid testing device formed with microconduits in a substrate.

BACKGROUND OF THE DISCLOSURE

Fluid evaluation techniques are well known. Broadly speaking, analysis of fluids may provide valuable data indicative of formation and wellbore parameters. Many fluids (such as formation fluids, production fluids, and drilling fluids) contain a large number of components with a complex composition. Fluids may contain oil and/or water insoluble compounds, such as clay, silica, waxes, and asphaltenes, which exist as colloidal suspensions. Fluids may also contain inorganic components.

The complex composition of fluids may be sensitive to changes in the environment, including movement of the fluid from one pressure to another or travel up a drill pipe. Movement to the surface may cause unwanted separation or precipitation within the fluid. This may interfere with analysis since the precipitate may drop out of the fluid as it is being moved to the surface. Even if the precipitate is recovered, it may not be possible to restore the original composition of the fluid through simple mixing. Additionally, some components of the fluid may change state (gas to liquid, or liquid to solid) when removed to surface conditions. This disclosure provides an apparatus and method for performing in situ analysis of fluids.

SUMMARY OF THE DISCLOSURE

In aspects, this disclosure generally relates to exploration for hydrocarbons involving in situ analysis of fluids in a borehole penetrating an earth formation. More specifically, this disclosure relates to analysis of fluids using a device formed with microconduits.

One embodiment according to the present disclosure includes an apparatus for estimating a parameter of interest in a downhole fluid, comprising: a conveyance device configured to traverse a borehole; a sampling device disposed on the conveyance device and configured to receive the downhole fluid; and at least one testing member disposed on the conveyance device, comprising: a substrate with at least one conduit configured to receive the downhole fluid, the at least one conduit having a cross-sectional area of less than 1 $cm^2$; and at least one sensor configured to operatively contact the downhole fluid in the at least one conduit.

Another embodiment according to the present disclosure includes a method for estimating a parameter of interest in a fluid sample, comprising: estimating the parameter of interest using an apparatus in a borehole, comprising: a conveyance device configured to traverse a borehole; a sampling device disposed on the conveyance device and configured to receive the downhole fluid; and at least one testing member disposed on the conveyance device, comprising: a substrate with at least one conduit configured to receive the downhole fluid, the at least one conduit having a cross-sectional area of less than 1 $cm^2$; and at least one sensor configured to operatively contact the downhole fluid in the at least one conduit.

Examples of the more important features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

This disclosure generally relates to exploration for hydrocarbons involving analysis of fluids. In one aspect, this disclosure relates to analysis of fluids using a device provided with microconduits. The term "microconduit" applies to channels small enough for fluids passing through the microconduit to demonstrate "microfluidic" behavior, as distinguished from macrofluidic behavior by one of skill in the art. In general, microfluidic flow in a microconduit diverges substantially from conventional models based on traditional Navier-Stokes equations. This disclosure encompasses fluid flow in conduits that are not characterized well by Navier-Stokes equations. In one aspect, a microconduit may have width and depth on a sub-millimeter scale, ranging from 1 to 1000 μm. In another aspect, a microconduit may have a depth on a sub-millimeter scale, but length and width above the sub-millimeter scale. In another aspect, typically, a microconduit may have a cross-sectional area of between 1 and 50,000 $\mu m^2$. Thus, for example, in some instances, the cross-sectional area is less than 50,000 $\mu m^2$, in other instances less than 10,000 $\mu m^2$, in still other instances less than 1000 $\mu m^2$, and in yet other instances less than 100 $\mu m^2$. In yet another aspect, a microconduit may have a cross-sectional less than 1 $\mu m^2$, as construction of microconduits may only be limited by methods known to those of skill in the art to form microconduits. For example, nano imprinting methods may be used to construct microconduits with widths and depths on the order of 20 nm. In another aspect, a microconduit may be small enough that capillary action forces substantially affect a fluid in the microconduit. In one aspect, substantially affecting a fluid may mean that capillary forces are sufficient to overcome the force of gravity on the fluid. In another aspect, substantially affecting may mean that capillary forces are sufficient to overcome the viscous drag of the fluid within or in proximity to the microconduit. Particularly at the size of microconduits, the Reynolds number of a fluid in a microconduit may be very low (less than 100, in some instances less than 1, and in other instances below $10^{-3}$) such that viscous forces typically overwhelm inertial forces, and fluids may not mix in the traditional sense. Microconduits may come in a variety of dimensions. The cross-section of a microconduit also comes in a variety of shapes, including tubular, conical, and rectangular. Herein, the prefix "micro-" relates to objects with at least one dimension on a scale similar to that of the microconduits.

Figure 1:
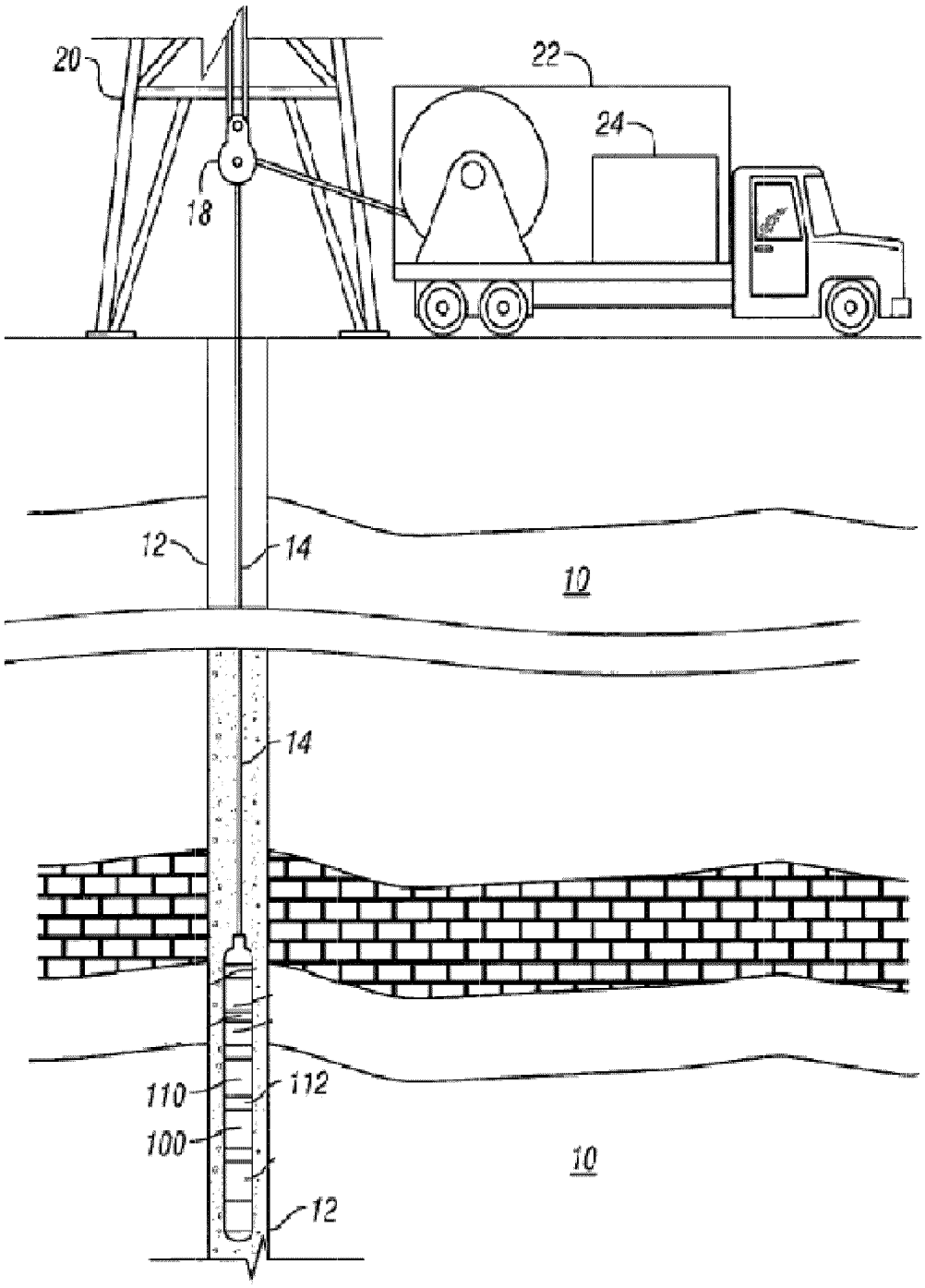
FIG. 1 shows a schematic of a fluid testing module deployed in a wellbore along a wireline according to one embodiment of the present disclosure.

Referring initially to FIG. 1, there is schematically represented a cross-section of a subterranean formation 10 in which is drilled a borehole 12. Suspended within the borehole 12 at the bottom end of a conveyance device such as a wireline 14 is a downhole assembly 100. The wireline 14 is often carried over a pulley 18 supported by a derrick 20. Wireline deployment and retrieval is performed by a powered winch carried by a service truck 22, for example. A control panel 24 interconnected to the downhole assembly 100 through the wireline 14 by conventional means controls transmission of electrical power, data/command signals, and also provides control over operation of the components in the downhole assembly 100. The data may be transmitted in analog or digital form. Downhole assembly 100 may include a fluid testing module 112. Downhole assembly 100 may also include a sampling device 110. Herein, the downhole assembly 100 may be used in a drilling system (not shown) as well as a wireline. While a wireline conveyance system has been shown, it should be understood that embodiments of the present disclosure may be utilized in connection with tools conveyed via rigid carriers (e.g., jointed tubular or coiled tubing) as well as non-rigid carriers (e.g., wireline, slickline, e-line, etc.). Some embodiments of the present disclosure may be deployed along with LWD/MWD tools.

Figure 2:
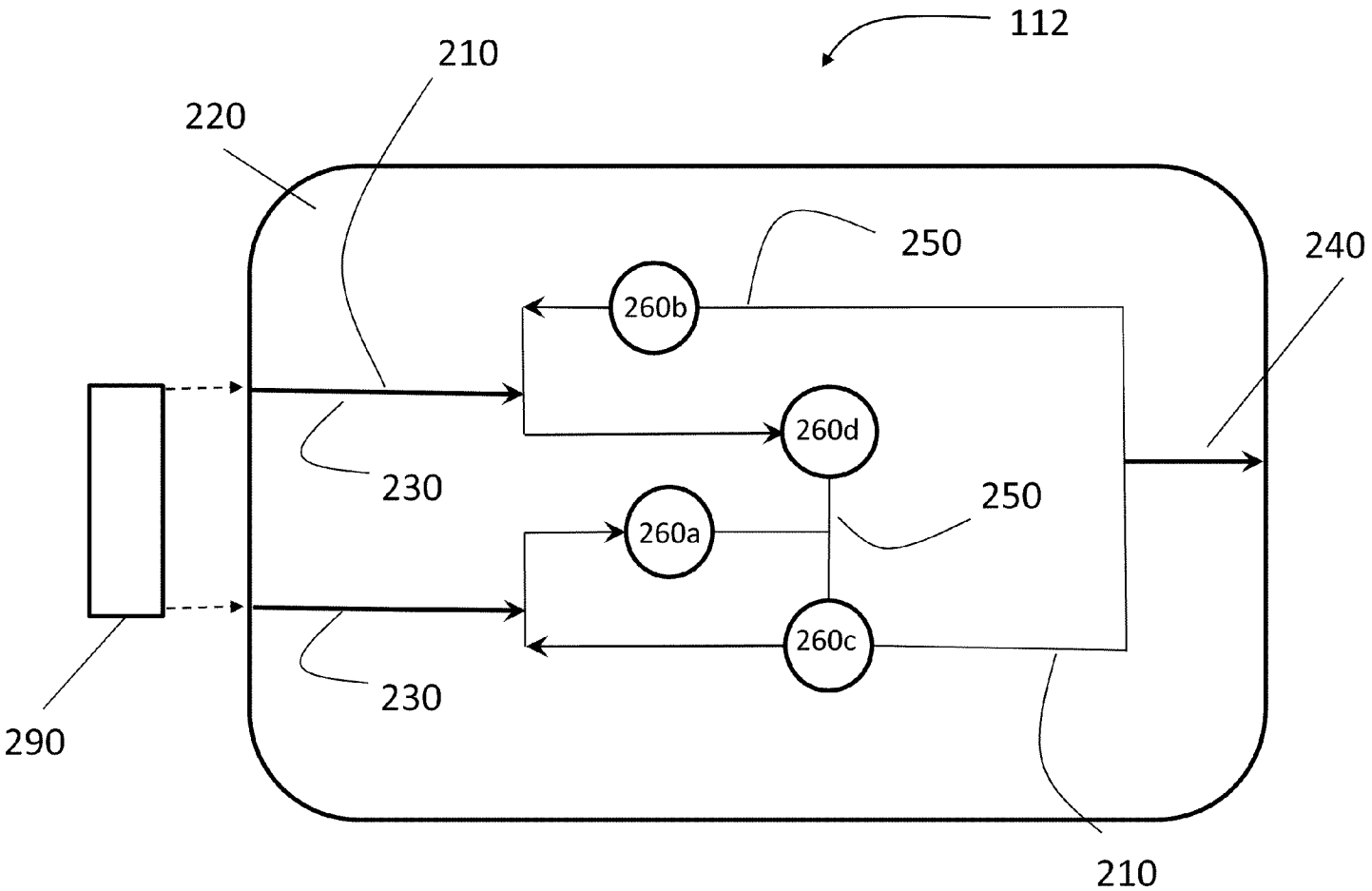
FIG. 2 shows a schematic of a fluid testing module according to one embodiment of the present disclosure.

FIG. 2 shows an exemplary embodiment of fluid testing module 112 for testing one or more fluids. Fluid testing module 112 may include one or more microconduits 210 in a substrate 220. The substrate 220 may be formed of any number of suitable materials, including, but not limited to, at least one of: (i) glass, (ii) plastic, (iii) polymer, (iv) metal composite, (v) silicon, (vi) sapphire, (vii) metal, and (viii) diamond. Microconduits may be formed in the substrate by one of numerous techniques known to those of skill in the art, including, but not limited to, at least one of: (i) photolithography, (ii) chemical etching, (iii) laser etching, (iv) micromachining, (v) screen printing, (vi) thin film processing, (vii) powder blasting, (viii) molding, (ix) embossing, (x) nano-imprinting, (xi) focused ion beam machining, (xii) plasma etching, (xiii) ion milling, and (xiv) MEMS fabrication. One or more microconduits 210 may form an input array 230 and an output array 240. Fluid may move into and out of the substrate 220 through input array 230 and output array 240, respectively. In some embodiments, one or more of the microconduits may serve as part of both arrays 230, 240. In some embodiments, microconduits may form a transportation network 250, which allows fluid to move from one part of the substrate to another. The transportation network 250 may be connected to input array 230, output array 240, and one or more microcells 260*a-d*. A microcell 260*a-d* may be a region of a microconduit within the substrate or simply an enlarged section of a microconduit 210. In some embodiments, a microcell may itself be a microconduit. Some microcells 260*a-d* may be used to store different fluids. Cleaning fluid may be stored in cleaning microcell 260*b*, and buffering fluid may be stored in a buffering fluid microcell 260*c*. A holding microcell 260*d* may be used to hold a desired fluid. In some embodiments, cleaning fluid and/or buffering fluid may be stored external to the substrate 220 and moved into the substrate 220 via the input array 230. An analysis microcell 260*a* may be in the substrate 220. By way of the transportation network 250, made up of microconduits 210, the microcells 260*a-d* may be physically connected to one or more of: (i) the input array 230, (ii) the output array 240, and (iii) other microcells 260*a-d*. In some embodiments, one or more of the microcells 260*a-d* may be retasked to perform an alternate function.

At the simplest level, the fluid testing module 112 may operate with a single microconduit 210 serving as input array, output array, and analysis microcell. Fluid may be moved through any of the microconduits and/or microcells by a fluid transporter 290. The fluid transporter 290 may move the fluid through the use of, but not limited to, one or more of: (i) acoustic waves, (ii) electrokinesis, (iii) electrochemistry, (iv) electrowetting, (v) optical pumping, and (vi) heat pumping. The form of fluid transporter used may be selected based on the type of fluid being analyzed. For example, acoustic wave based fluid transport may required high frequencies (typical acoustic fluid transport operates at over 100 Hz) that may affect the fluid to be tested adversely or beneficially. In another example, electrical based fluid transport (such as electrokinesis, electrochemistry, and electrowetting) may involve implantation of electrodes into the substrate or generation of specific frequencies of electrical energy, either of which may adversely or beneficially impact the fluid to be tested. Fluid transporter 290 may move fluid into and out of the substrate along the input and output arrays 230, 240. Fluid transporter 290 may also move cleaning fluid into microconduits or microcells to clean at least part of the substrate 220. Fluid transporter 290 may also move buffering fluid to aid in moving other fluids, including the fluid to be tested, through the microconduits. This means that the fluid transporter 290 may move a fluid through a microconduit 210 directly or indirectly (via a buffering fluid). Herein, moving the fluid through or across a microconduit means that the fluid is move at least partially through or across the microconduit 210. The use of indirect movement may be advantageous in situations where the operation of the fluid transporter 290 on the primary fluid may interfere with proper analysis of the primary fluid. In some embodiments, the fluid transporter 290 may use pressure reduction to move fluid. Arrows shown on FIG. 2 are exemplary of fluid flow through the microconduits and microcells; however, they are illustrative only. The fluid transporter 290 may be configured to reverse the flow of one or more of the microconduits 210.

In some embodiments, the fluid testing module 112 may be divisible into internal sections. These internal sections may be permanent, where the isolation may be provided by a permanent barrier such as the substrate material, or temporary, where isolation may be provided by controllable isolation devices (not shown), such as microvalves or membranes in the microconduits or microcells to isolate internal sections. In some embodiments, at least one microconduit may include a mixer (not shown) and/or a separator (not shown). In some embodiments, micro-cantilevers may be disposed in the microconduits to estimate parameters of the fluid, such as viscosity. In some embodiments, at least one of the microconduits may include at least one sieve (not shown). In some embodiments, sieves may be cleaned or have fluid flow improved by an acoustic generator, such as an ultrasonic wave generator. In some embodiments, the filtering function of a sieve may be performed with low frequency vibrations from an acoustic generator. In some embodiment, one or more of the devices on a the fluid testing module 112, such as the fluid transporter 290, controllable isolation devices, mixer, and separator, may be powered by a power cell (not shown) located on the fluid testing module 112, including, but not limited to, one of: (i) a photoelectric cell, and (ii) an electrochemical cell. In some embodiments, the power cell may use or be located in a microcell. In another embodiment, some or all operations of the fluid testing module 112 may be powered by power generated on or within the fluid testing module 112 by using vibration energy or a heat gradient generated by a source external to the fluid testing module 112.

Figure 3:
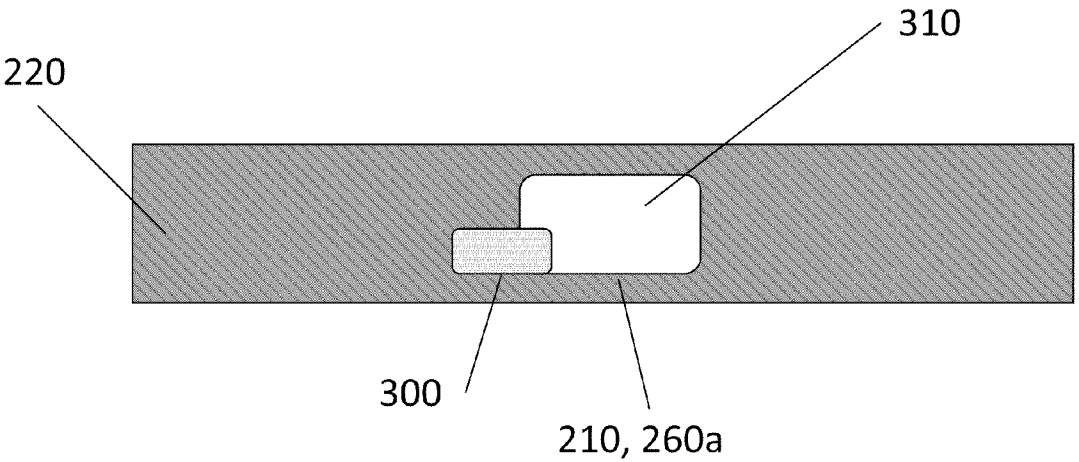
FIG. 3 shows a schematic of a sensor within a microcell according to one embodiment of the present disclosure.

FIG. 3 shows an exemplary embodiment of an analysis microcell 260*a*. The microcell 260*a* may include a sensor 300 disposed within the microcell 260*a* such that at least part of the sensor may be exposed to the interior of the microcell 260*a*. While sensor 300 is shown attached to the substrate interior of microcell 260*a*, this is merely exemplary, as in other embodiments, sensor 300 may float within microcell 260*a* or be attached to another structure within microcell 260*a*. When a fluid 310 enters the microcell 260*a*, the fluid 310 may come in contact with sensor 300. In some embodiments, sensor 300 may receive a signal or radiation from a source 320 outside the microcell 260*a* that transmits the signal or radiation through the fluid 310 to sensor 300. In some embodiments, the source 320 and the sensor 300 may both be located within the same or different microcells 260*a-d*. In some embodiments, all microcells 260*a-d* may be equipped with sensors 300 disposed within so that the fluid testing module 112 may be reconfigured without removal from its in situ location, such as in a borehole. Fluid 310 may be a fluid including, but not limited to, one or more of: (i) drilling fluid, (ii) production fluid, and (iii) formation fluid. Fluid 310 may be analyzed for, but not limited to, one or more of: (i) pH, (ii) $H_2S$, (iii) density, (iv) viscosity, (v) temperature, (vi) pressure, (vii) thermal conductivity, (viii) electrical resistivity, (ix) chemical composition, (x) reactivity, (xi) radiofrequency properties, (xii) surface tension, (xiii) infra-red absorption, (xiv) ultraviolet absorption, (xv) refractive index, and (xvi) rheological properties.

Figure 4:
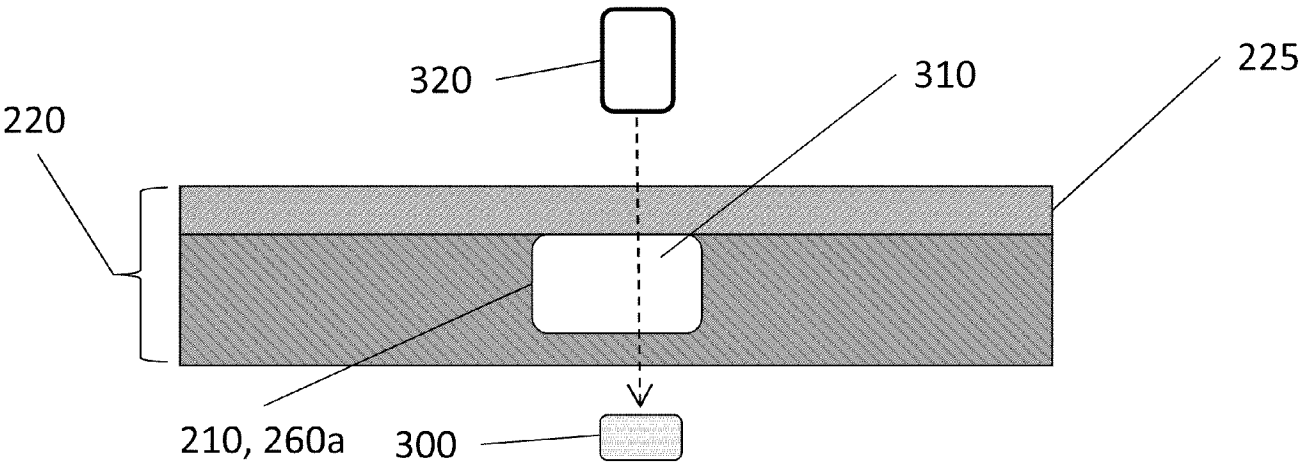
FIG. 4 shows a schematic of a sensor outside a microcell according to one embodiment of the present disclosure.

FIG. 4 shows another exemplary embodiment of an analysis microcell 260*a* that may be included in the fluid testing module 112. In some embodiments, sensor 300 may be located outside of the substrate 220 but positioned such that the sensor 300 may receive a signal or radiation transmitted from an energy source 320 through the fluid 310 in the microcell 270 or a microconduit 210. In some embodiments, part or all of the substrate 220 may be at least partially transparent to at least part of the energy transmitted by energy source 320. In some embodiments, the substrate 220 may be formed with more than one layer wherein at least one layer 225 may be at least partially transparent to the energy transmitted by energy source 320. The energy source 320 may transmit at least one frequency of electromagnetic radiation. In some embodiments, the energy source 320 may be used in conjunction with sensor 300 to perform interferometric analysis (such as refractive index analysis and spectral analysis) on the fluid. In some embodiments, energy source 320 may generate acoustic waves to perform acoustic spectroscopy on the fluid 310. In yet another embodiment, fluid transporter 290 may be configured to perform a dual role as both fluid transporter and acoustic generator for fluid analysis, such as acoustic spectroscopy. In some embodiments, sensor 300 may be embedded in at least one layer of the substrate 220.

Figure 5:
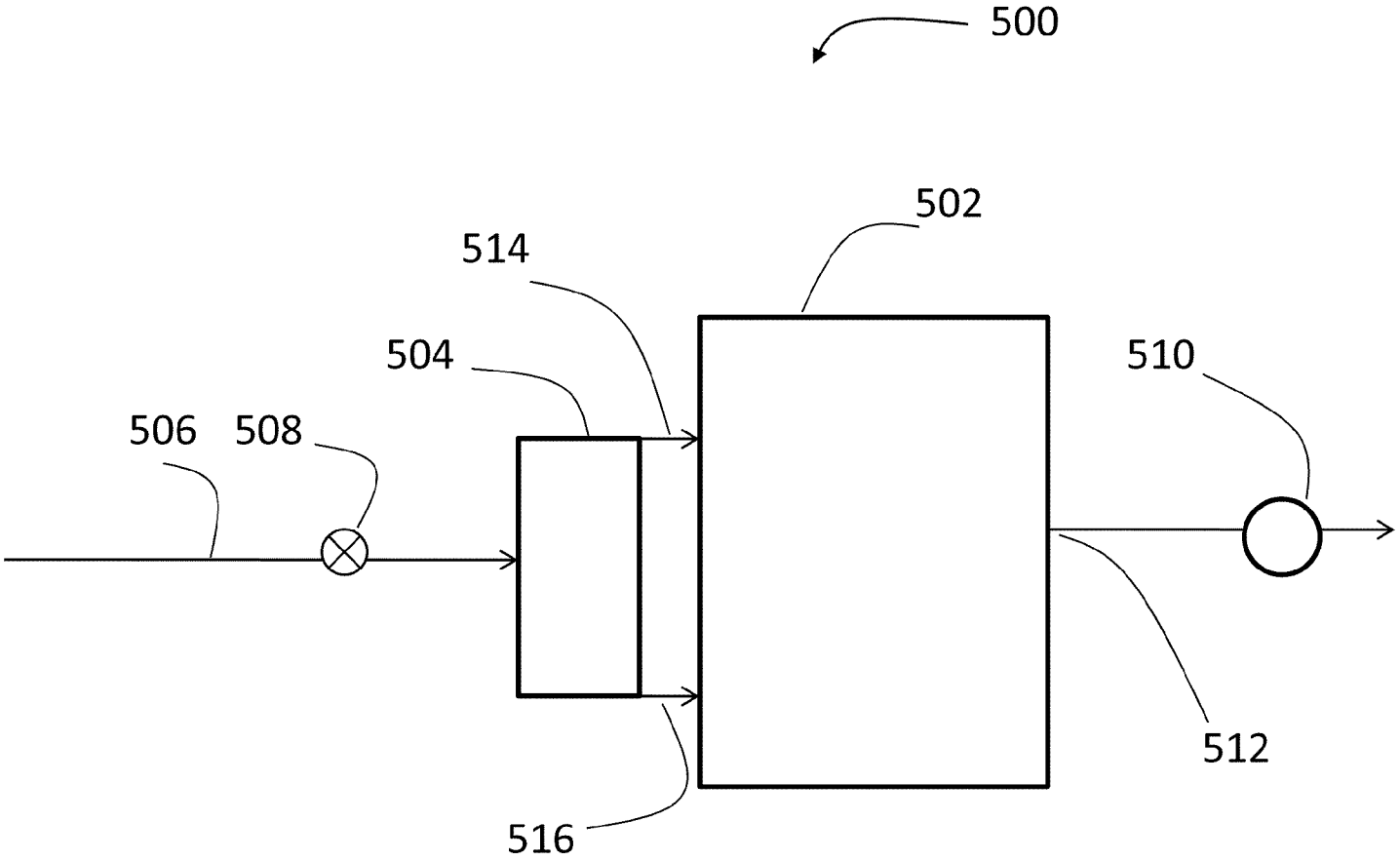
FIG. 5 shows a schematic of a sampling unit with a separator according to one embodiment of the present disclosure.

Referring now to FIG. 5, there is shown another embodiment of a sampling device 500 made in accordance with the present disclosure. The device 500 includes a sampling unit 502 that receives fluids from a separator 504. Flow into the separator may be controlled using a suitable input 506 that is controlled by a valve element 508. Flow across the sampling unit 502 may be induced by a pressure reduction device 510 that reduces pressure at a flow outlet 512 of the sampling unit 502. In one embodiment, the separator 504 may use gravity to separate the fluid phases (e.g., liquid, gases, etc.). In another embodiment, the separator 504 may include filtering elements that segregate fluids according to the size of entrained colloids. That is, for examples, a fluid stream having colloids less than a given size may be directed to a first flow branch 514. In some embodiments, the filtering elements may be pillar-like elements that have interstitial spaces of a pre-determined size. The remainder of the fluid stream may be directed along a second flow branch 516. In embodiments, the fluid stream may be separated into three or more branches, each conveying fluids having a specified characteristic. The pressure reduction device 510 may be a pump that generates a vacuum in the microconduits (not shown) in the sampling unit 502 to generate fluid flow.

Figure 6:
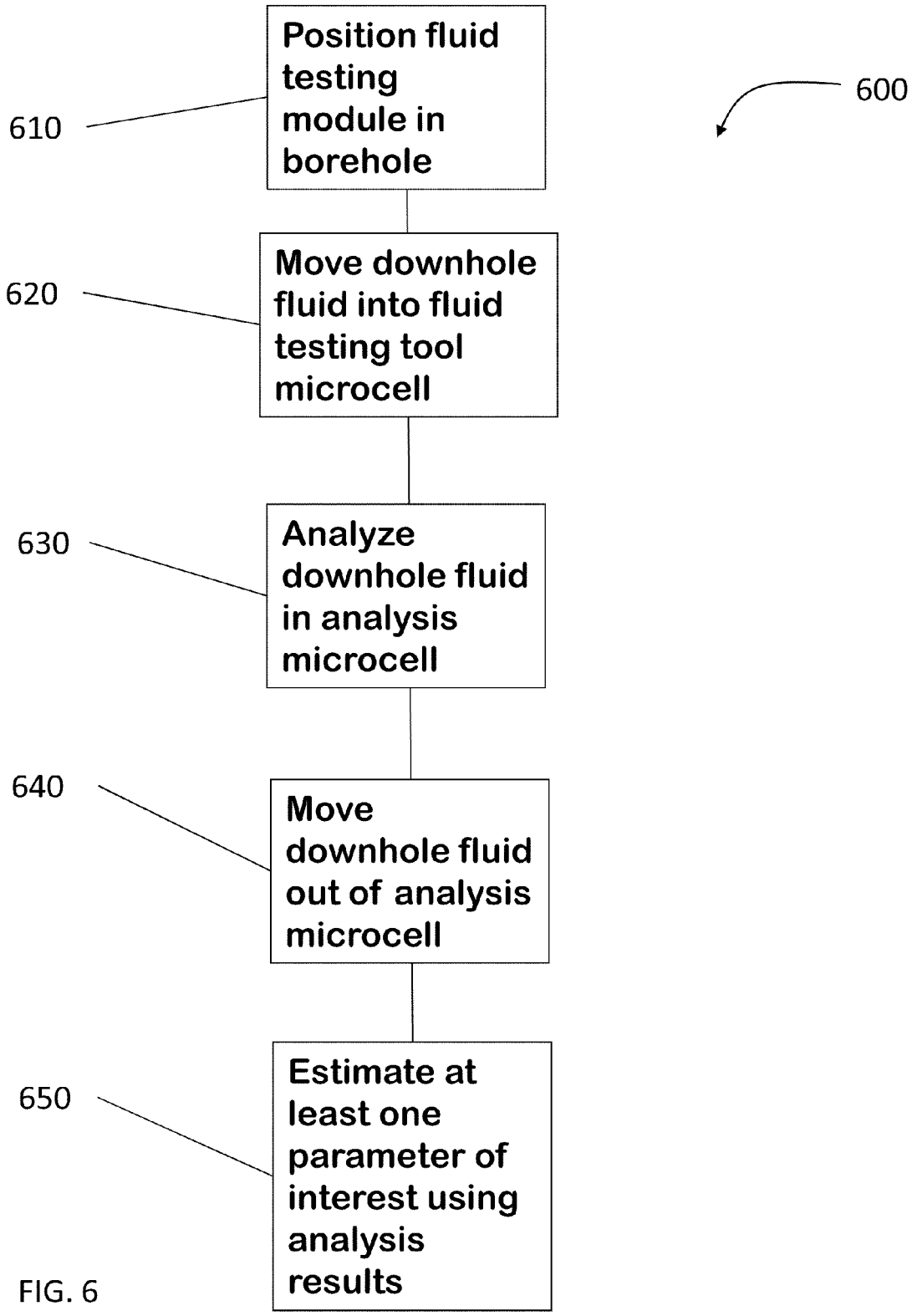
FIG. 6 shows a flow chart of a method for estimating a parameter of interest using a fluid testing module according to one embodiment of the present disclosure.

FIG. 6 shows an exemplary method 600 according to one embodiment of the present disclosure. In method 600, a fluid testing module 112 may be positioned within a borehole 12 in step 610. In some embodiments, the fluid testing module 112 may be configured to permanently reside downhole. Then, in step 620, fluid may be moved into the fluid testing module 112 from the borehole 12 or a sampling device 110 to an analysis microcell 260*a*, which may involve moving the fluid through input array 230. In step 630, analysis may be performed on the fluid in microcell 260*a*. In some embodiments, analysis may include exposing the fluid in the analysis area to energy from energy source 320. In step 640, the fluid is moved out of the analysis microcell 260*a*. In some embodiments, such as when the fluid testing module is a single use only device, step 640 need not be performed. In some embodiments, the fluid may be moved out of the fluid testing module 112 by way of the output array 240. In other embodiments, the fluid may be moved from a first analysis microcell 260*a* to another analysis microcell 260*a* for another test. In some embodiments, step 640 may be performed by the fluid transporter 290 moving the fluid directly (such as with acoustic waves) or indirectly (such as flushing the analysis microcell with buffering fluid or cleaning fluid). In some embodiments, the cleaning and/or buffering fluid may be supplied from one or more microcells 260*a-d*, supplied from the surface, and/or extracted from the downhole environment. In some embodiments, particularly when the cleaning and/or buffering fluid may be extracted from the downhole environment, the fluid testing module 112 may be configured to process the extracted fluid into a suitable buffering and/or cleaning fluid. In step 650, a parameter of interest of the fluid may be estimated based on the estimate by the sensor 300 in the analysis microcell 260*a*. In some embodiments, a plurality of fluid testing modules 112 may be operated simultaneously. In one embodiment, fluid tested in a first fluid testing tool may be moved to a second fluid testing tool for the same or a different analysis. In yet another embodiment, a first fluid may be analyzed in step 630, and then a second fluid may be moved into the same analysis microcell 260*a* without the first fluid being removed, hence not performing step 640.

Figure 7:
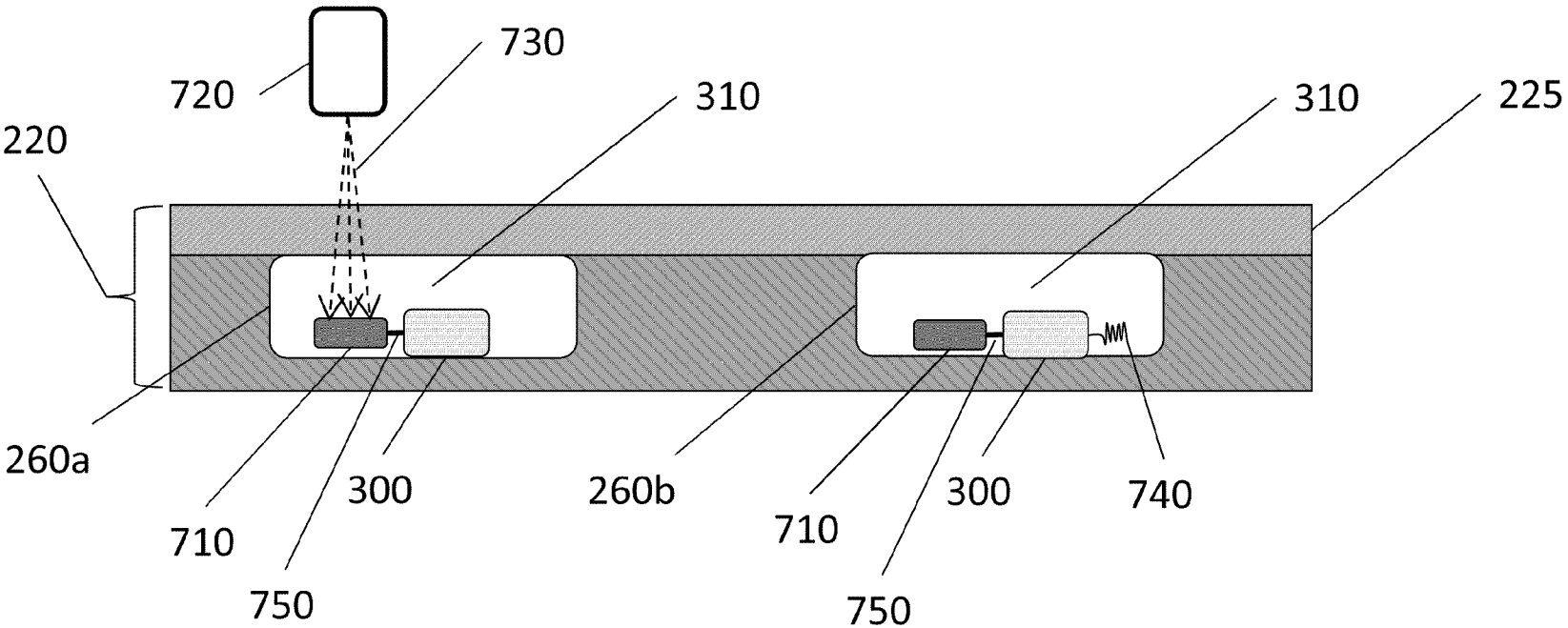
FIG. 7 shows a schematic of a sensor within a microcell with a remote power source according to one embodiment of the present disclosure.

FIG. 7 shows another exemplary embodiment of an analysis microcell 260*a* that may be included in the fluid testing module 112 configured for the sensor 300 to receive power from a power source 710 according to the present disclosure.

The remote power source 710 may be configured to generate power using transmitted energy 730 from an external power source 720. Remote power source 710 may be contained within the substrate 220 such that substrate 220 may prevent a physical connection (wires, etc.) for transferring energy from external power source 720 to remote power source 710. The transmitted energy 730 may include, but is not limited to, one or more of: i) electromagnetic radiation, ii) electric fields, and iii) magnetic fields. One non-limiting example of remote power source 710 may be a Gratzel cell. The substrate 220 may be at least partly transparent to the transmitted energy 730. In some embodiments, the substrate 220 may include at least one partly transparent layer 225 configured to allow the passage of the transmitted energy 730 from external power source 720 to remote power source 710. External power source 720 may include, but is not limited to, one or more of: i) an electromagnetic radiation source, ii) electric field source, and iii) a magnetic field source. The power source 710 may supply power to sensor 300 over a conductor 750. In some embodiments, the power source 710 may be coupled directly to sensor 300 without the use of conductor 750.

While shown in the interior of analysis microcell 260*a* with sensor 300, remote power source 710 may be configured to deliver power to sensor 300 while remote power source 710 may be located at least partly within substrate 220. Remote power source 710 may be configured to float within analysis microcell 260*a*. In some embodiments, remote power source 710 may receive energy from energy source 320 (FIG. 3). In some embodiments, a remote power source 710 may be included in microcells 260*a-d* configured for functions other than or in addition to fluid analysis, including, but not limited to, fluid transport, fluid isolation, and mixing, separation, and signal generation. In some embodiments, a communication antenna 740 may be configured to transmit and/or receive information from/to sensor 300. While FIG. 7 shows two embodiments together, a first with an external power source 720 and a second with communication antenna 740, this is exemplary only, and the embodiments may be used together or separately.

In some embodiments, external power sources 720 may be configured for reuse or repurposing. In some embodiments, all microcells 260*a-d* may be equipped with remote power sources 710 associated with sensors 300 disposed within so that one or more external power sources 720 may power the operation of the sensors in the microcells 260*a-d*. If, or when, a microcell 260*a-d* may no longer be needed, the external power source 720 may be used for a different purpose, including powering another remote power source 710. In some embodiments, remote power source 710 may be configured to power other or additional devices, including, but not limited to, or more of: i) a fluid transporter, ii) a controllable isolation device, iii) a mixer, iv) a separator, and v) a signal generator.

In some embodiments, the method may include one or more modes of investigation, including, but not limited to, droplet investigation and continuous investigation. Continuous investigation may include simultaneous testing of fluids taken from one or more samples of fluid. Droplet investigation may include performing an analysis of a fluid and then moving the tested fluid to another fluid testing module or a different location on the same fluid testing module for additional testing. In some embodiments, the fluid testing module may be sufficient in capability to perform both modes of investigation within the same substrate.

While the foregoing disclosure is directed to the one mode embodiments of the disclosure, various modifications will be apparent to those skilled in the art. It is intended that all variations be embraced by the foregoing disclosure.

We claim:

1. An apparatus for estimating a parameter of interest in a downhole fluid, comprising:

a conveyance device configured to traverse a borehole;

a sampling device disposed on the conveyance device and configured to receive the downhole fluid;

at least one testing member disposed on the conveyance device, comprising:

a substrate with at least one conduit configured to receive the downhole fluid, the at least one conduit having a cross-sectional area of less than 1 $cm^2$, and at least one sensor configured to operatively contact the downhole fluid in the at least one conduit.

2. The apparatus of claim 1, wherein the at least one sensor is disposed at least partially within the at least one conduit.

3. The apparatus of claim 1, further comprising:

a fluid transporter configured to move the fluid across the at least one conduit, the fluid transporter comprising at least one of: (i) an acoustic system, (ii) an electrochemical system, (iii) an electrokinetic system, and (iv) and electrowetting system.

4. The apparatus of claim 1, further comprising at least one of: (i) a buffering system and (ii) a cleaning system.

5. An apparatus of claim 1, wherein the substrate allows passage to at least one selected frequency of electromagnetic radiation, and wherein the at least one sensor is responsive to the at least one selected frequency of electromagnetic radiation.

6. The apparatus of claim 1, further comprising:

at least one remote power source disposed within the substrate, the at least one remote power source being configured to generate power using energy from outside the substrate and deliver power to the at least one sensor.

7. The apparatus of claim 6, further comprising:

at least one external power source disposed outside the substrate, the at least one external power source being configured to transmit energy to the at least one remote power source.

8. The apparatus of claim 6, wherein the at least one remote power source is configured to generate power in response to at least one of: i) a magnetic field, ii) an electric field, and iii) electromagnetic radiation.

9. The apparatus of claim 6, wherein the at least one remote power source is disposed at least partially within the at least one conduit.

10. A method for estimating a parameter of interest in a fluid sample, comprising:

estimating the parameter of interest using an apparatus in a borehole, comprising:

a conveyance device configured to traverse a borehole;

a sampling device disposed on the conveyance device and configured to receive the downhole fluid;

at least one testing member disposed on the conveyance device, comprising:

a substrate with at least one conduit configured to receive the downhole fluid, the at least one conduit having a cross-sectional area of less than 1 $cm^2$, and at least one sensor configured to operatively contact the downhole fluid in the at least one conduit.

11. The method of claim 10, wherein the at least one sensor is disposed at least partially within the at least one conduit.

12. The method of claim 10, further comprising:

moving the downhole fluid across the at least one conduit.

13. The method of claim 12, using, for moving the downhole fluid across the at least one conduit, a fluid transporter comprising at least one of: (i) an acoustic system, (ii) an electrochemical system, (iii) an electrokinetic system, and (iv) and electrowetting system.

14. The method of claim 10, using, for the substrate, a material that allows passage to at least one selected frequency of electromagnetic radiation, wherein the at least one sensor is responsive to the at least one selected frequency of electromagnetic radiation.

15. The method of claim 10, using, to power to at least one sensor at least one remote power source disposed within the substrate, the at least one remote power source being configured to generate power using energy from outside the substrate and deliver power to the at least one sensor.

16. The method of claim 15, further comprising:

at least one external power source disposed outside the substrate, the at least one external power source being configured to transmit energy to the at least one remote power source.

17. The method of claim 15, wherein the at least one remote power source is configured to generate power in response to at least one of: i) a magnetic field, ii) an electric field, and iii) electromagnetic radiation.

18. The method of claim 15, wherein the at least one remote power source is disposed at least partially within the at least one conduit.

19. The method of claim 10, further comprising:

cleaning the at least one conduit.

20. The method of claim 10, further comprising:

moving a buffering solution across the at least one conduit.

* * * * *